US007621389B2

(12) United States Patent
Park

(10) Patent No.: US 7,621,389 B2
(45) Date of Patent: Nov. 24, 2009

(54) CURVATURE-ADJUSTABLE HANDRAIL LENGTH COMPENSATION DEVICE FOR AN ESCALATOR AND A MOVING WALKWAY

(75) Inventor: Chan Jong Park, Gyeonggi-do (KR)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 11/722,830

(22) PCT Filed: Dec. 21, 2005

(86) PCT No.: PCT/US2005/046882

§ 371 (c)(1),
(2), (4) Date: Jun. 26, 2007

(87) PCT Pub. No.: WO2006/073904

PCT Pub. Date: Jul. 13, 2006

(65) Prior Publication Data

US 2008/0135377 A1 Jun. 12, 2008

(30) Foreign Application Priority Data

Dec. 31, 2004 (KR) ..... 10-2004-0117802

(51) Int. Cl.
*B66B 23/22* (2006.01)

(52) U.S. Cl. ..... 198/335; 198/337

(58) Field of Classification Search ..... 198/330, 198/331, 335, 336
See application file for complete search history.

(56) References Cited

U.S. PATENT DOCUMENTS

| | | | | |
|---|---|---|---|---|
| 3,779,360 | A * | 12/1973 | Taher et al. | 198/335 |
| 4,134,883 | A * | 1/1979 | Mendelsohn et al. | 198/335 |
| 4,564,099 | A | 1/1986 | Uozumi | |
| 4,895,240 | A | 1/1990 | Bruehl et al. | |
| 5,117,960 | A * | 6/1992 | Ahls et al. | 198/335 |
| 5,307,920 | A | 5/1994 | Meyer et al. | |
| 5,341,909 | A * | 8/1994 | Ahls et al. | 198/335 |
| 5,881,859 | A | 3/1999 | Bianchi | |

OTHER PUBLICATIONS

PCT International Search Report and Written Opinion of the International Searching Authority for International application No. PCT/US05/46882 filed Dec. 12, 2005.

* cited by examiner

*Primary Examiner*—James R Bidwell
(74) *Attorney, Agent, or Firm*—Carlson, Gaskey & Olds PC

(57) ABSTRACT

A curvature-adjustable handrail length compensation device for an escalator or a moving walkway is provided. The device comprises a frame, handrail support mounted along a length of the frame, and springs mounted to the frame to elastically support the handrail support. Each handrail support includes a supporting rod movably mounted through the frame, a first supporting roller mounted to an end of the supporting rod to support the handrail, and a stopper formed at the other end of the supporting rod. The spring is provided between the frame and the first supporting roller, and biases the first supporting roller away from the frame.

13 Claims, 6 Drawing Sheets

CURVATURE-ADJUSTABLE HANDRAIL LENGTH COMPENSATION DEVICE FOR AN ESCALATOR AND A MOVING WALKWAY

CROSS REFERENCE TO RELATED APPLICATIONS

This application claims priority to International Application No. PCT/US2005/046882 filed 21 Dec. 2005, which claims priority to Korean Application No. 10-2004-117802 filed 31 Dec. 2004.

FIELD OF THE INVENTION

The present invention relates to an escalator and a moving walkway, and more particularly, to a curvature-adjustable handrail length compensation device for an escalator and a moving walkway.

BACKGROUND OF THE INVENTION

FIG. 1 shows a prior art handrail driving unit and handrail guiding device of an escalator system. Pulley 2 for driving handrail 1 is rotated by a main sprocket of a motor via driving chain 6. The inner surface of handrail 1 is urged against the outer peripheral surface of driving pulley 2 by pressing rollers 5. As driving pulley 2 rotates, handrail 1 moves by a frictional force between the peripheral surface of driving pulley 2 and the inner surface of handrail 1.

In a passenger conveying area, handrail 1 is supported by continuous guiding means. However, in a return area (shown in FIG. 1), handrail 1 is supported discontinuously by guiding means in order to reduce moving resistance. Especially, upper handrail guiding device 4 and lower handrail guiding device 3 are provided near driving pulley 2 for guiding the movement of handrail 1 while reducing the moving resistance.

FIGS. 2*a* and 2*b* are side views showing respectively upper handrail guiding device 4 and lower handrail guiding device 3. Upper and lower handrail guiding devices 4 and 3 commonly include curved frames 8 and 12, first supporting rollers 9 coupled to curved frames 8 and 12, and second supporting rollers 10 disposed above first supporting rollers 9. Curved frames 8 and 12 are fixed to a truss by brackets 11*a*, 11*b*, 13*a* and 13*b*. Handrail 1 is placed between first supporting rollers 9 and second supporting rollers 10 in such a manner that the outer surface of handrail 1 is contactingly supported by first supporting rollers 9. Second supporting rollers 10 are spaced from the inner surface of handrail 1 at a predetermined interval and prevent handrail 1 from meandering.

When the escalator moves upward in the passenger conveying area, handrail 1 in the return area moves downward. Because driving pulley 2 provides a tensile strength to handrail 1, handrail 1 moves while being supported by first supporting rollers 9 of upper handrail guiding device 4. However, a portion of handrail 1 passing by driving pulley 2 tends to be loosened and wrinkled at lower handrail guiding device 3. So, the inner surface of handrail 1 contacts second supporting rollers 10 of lower handrail guiding device 3, thereby increasing the moving resistance of handrail 1. To solve this problem, the escalator system typically includes a device (not shown) for compensating the length of the loosened or wrinkled handrail at the lower landing zone.

When the escalator moves downward in the passenger conveying area, handrail 1 in the return area moves upward. So, a portion of handrail 1 passing by driving pulley 2 tends to be loosened and wrinkled at upper handrail guiding device 4. However, since the existing handrail length-compensating device mounted to the lower landing zone cannot cope with the wrinkling of handrail 1 at upper handrail guiding device 4, the inner surface of handrail 1 severely collides with second supporting roller 10. Thus, the inner surface of handrail 1 may be seriously damaged due to the collisions, and friction between the inner surface of handrail 1 and second supporting roller 10 sharply increases, causing deterioration of the operational stability of the escalator system.

FIG. 3 shows another prior art handrail guiding device in order to address and resolve the aforesaid problems. The prior art device comprises curved frame 14 and a plurality of supporting rollers 16 and 17 mounted to curved frame 14. Frame 14 is elastically mounted to the truss by means of spring 15. Thus, when handrail 1 moves upward in the return area, the prior art device compensates the length of loosened or wrinkled handrail 1 passing by the driving pulley by moving up and down due to spring 15. However, since supporting rollers 16 and 17 are fixedly arranged in accordance with the predetermined curvature of curved frame 14 and unitarily move up and down together with frame 14, the prior art device cannot optimally compensate the length of wrinkled handrail 1. Further, handrail 1 may be bent steeply near supporting rollers 16 and 17 positioned at the leftmost and rightmost ends (as shown in FIG. 3), causing serious physical damage to handrail 1.

SUMMARY OF THE INVENTION

Exemplary embodiments of the invention provide a curvature-adjustable handrail length compensation device for an escalator and a moving walkway, which can prevent wrinkling of the handrail and ensure operational stability of the escalator or moving walkway.

In particular, an exemplary embodiment includes a curvature-adjustable handrail length compensation device comprising a frame; handrail support mounted along a length of the frame; and springs mounted to the frame to elastically support the handrail support. The handrail support moves independently up and down by the springs.

An exemplary embodiment further includes that each handrail support includes a supporting rod movably mounted through the frame, a first supporting roller mounted to an end of the supporting rod to support the handrail, and a stopper formed at the other end of the supporting rod. The spring is provided around the supporting rod between the frame and the first supporting roller, and biases the first supporting roller away from the frame.

In addition, one or more handrail support further includes a second supporting roller disposed above the first supporting roller so that the handrail moves therebetween.

BRIEF DESCRIPTION OF THE DRAWINGS

Exemplary embodiments of the present invention will become more apparent from the following description of the embodiments given in conjunction with the accompanying drawings.

DETAILED DESCRIPTION

Exemplary embodiments of the present invention will now be described with reference to the accompanying drawings.

Figure 1:
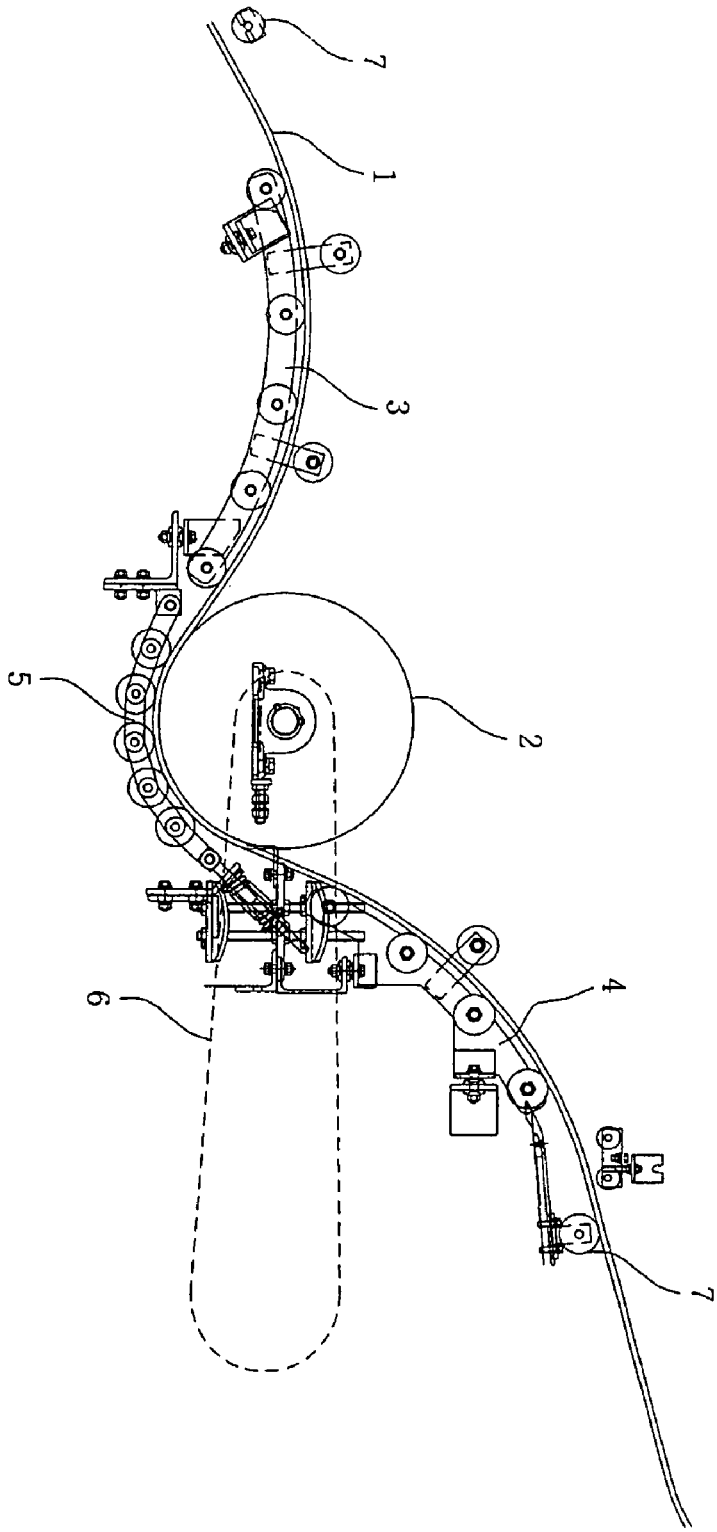
Fig. 1 (Prior Art)
FIG. 1 is a side view showing a prior art handrail driving unit and handrail guiding device of an escalator system.
Figure 2A:
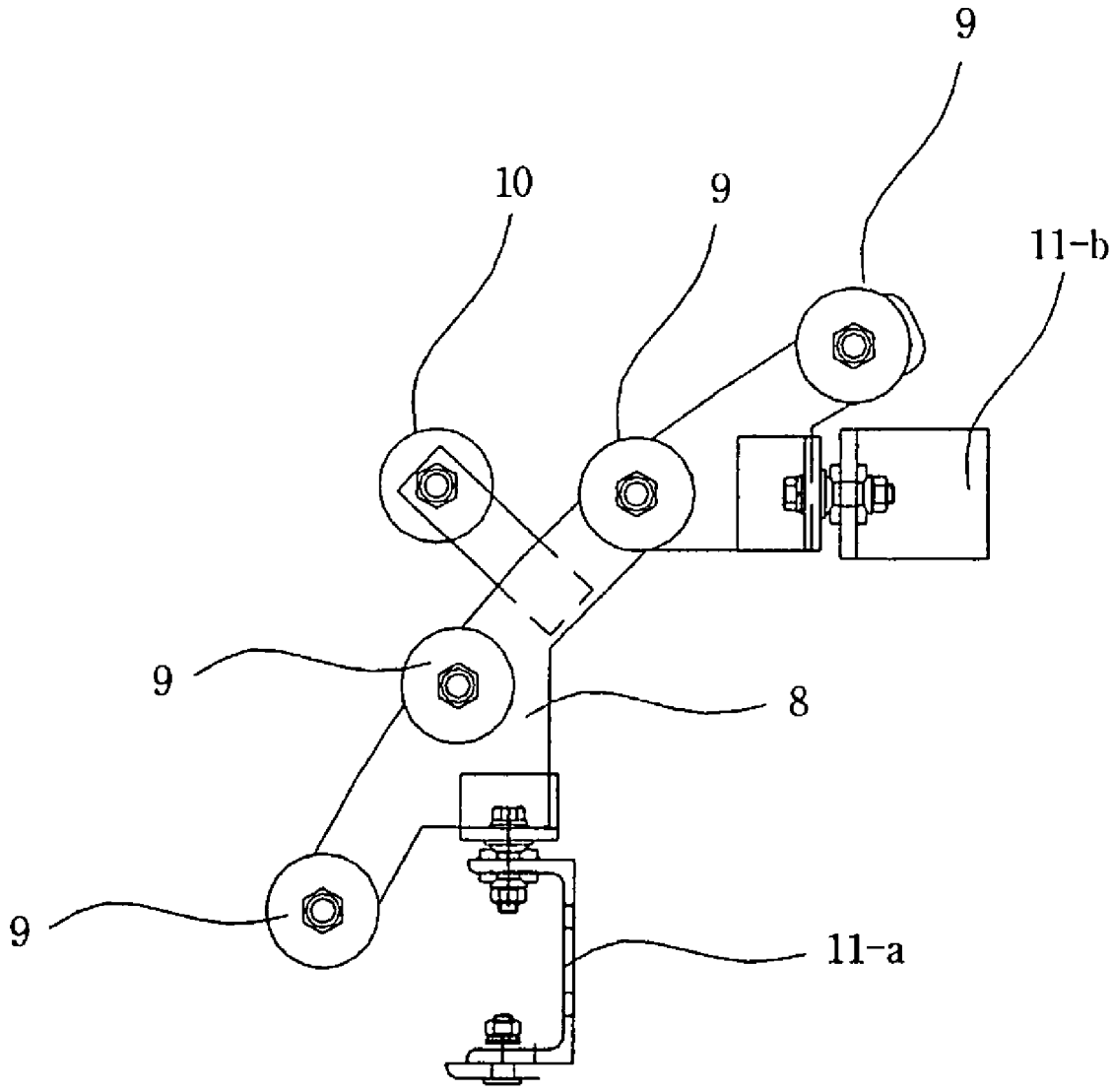
Fig. 2a (Prior Art)
FIG. 2*a* is a side view showing an upper handrail guiding device.
Figure 2B:
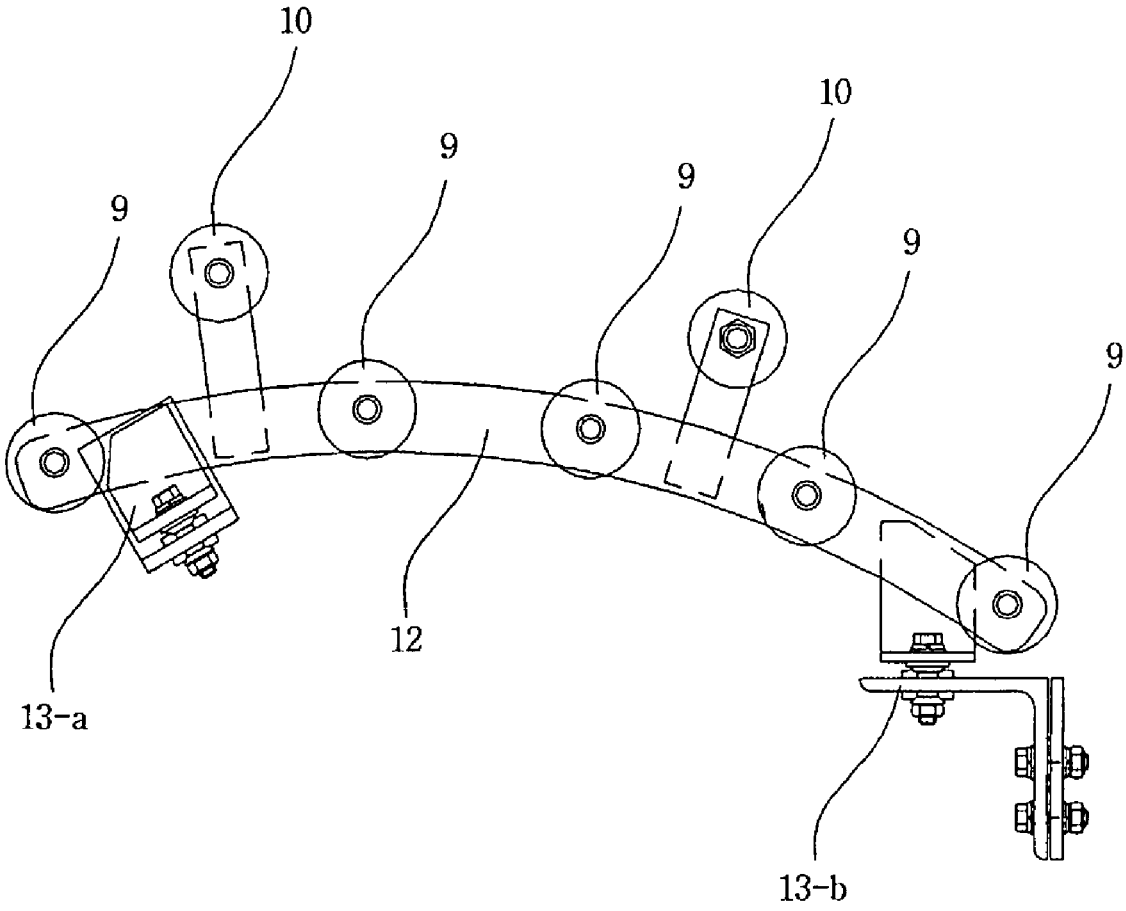
Fig. 2b (Prior Art)
FIG. 2*b* is a side view showing a lower handrail guiding device.
Figure 3:
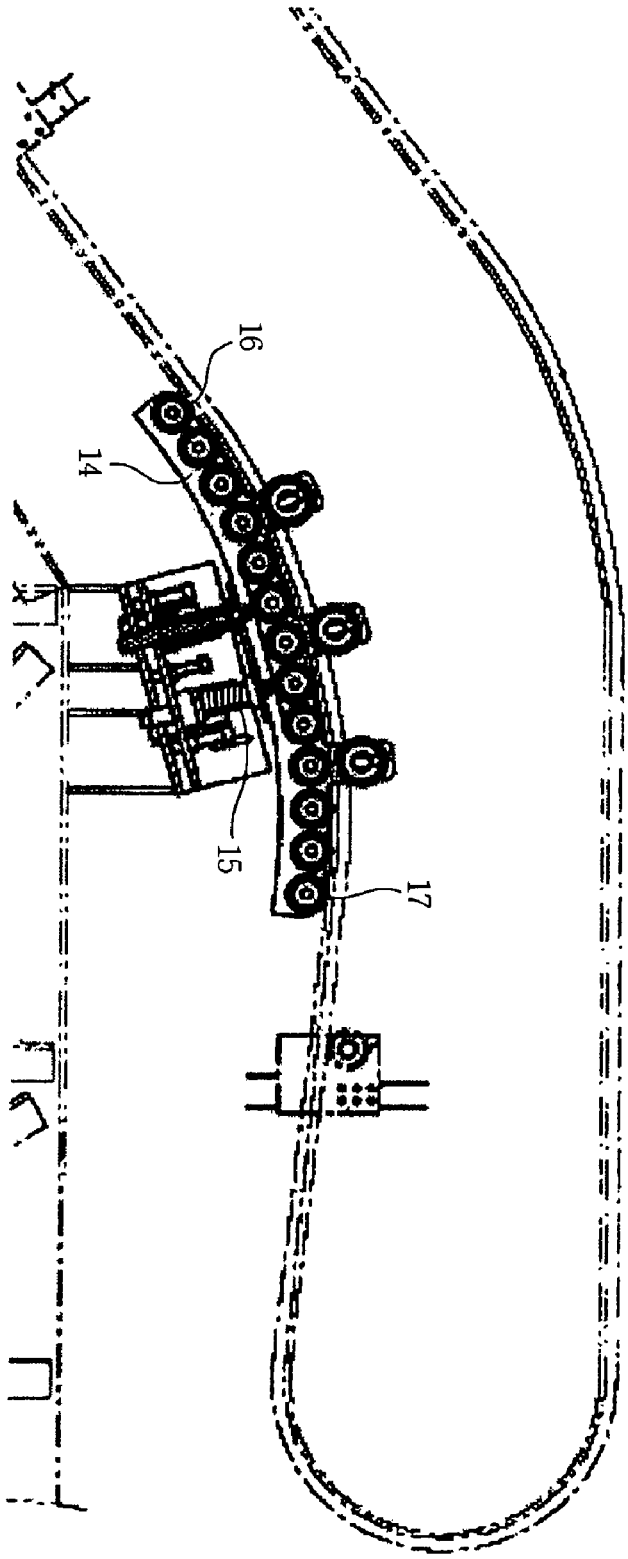
Fig. 3 (Prior Art)
FIG. 3 is a side view showing another prior art handrail guiding device.
Figure 4A:
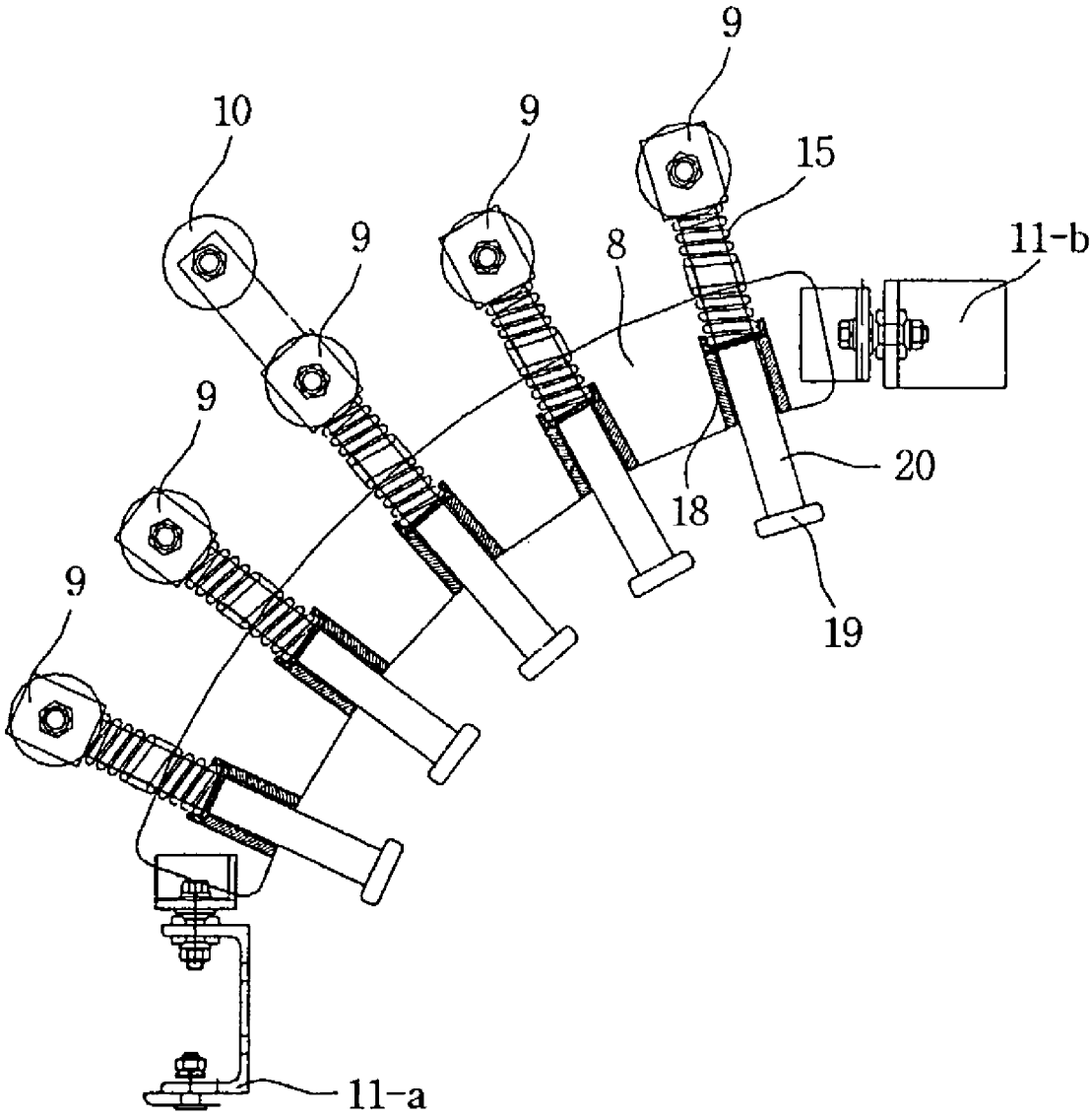
FIG. 4*a* is a side view showing a curvature-adjustable handrail length compensation device in accordance with the present invention.
Figure 4B:
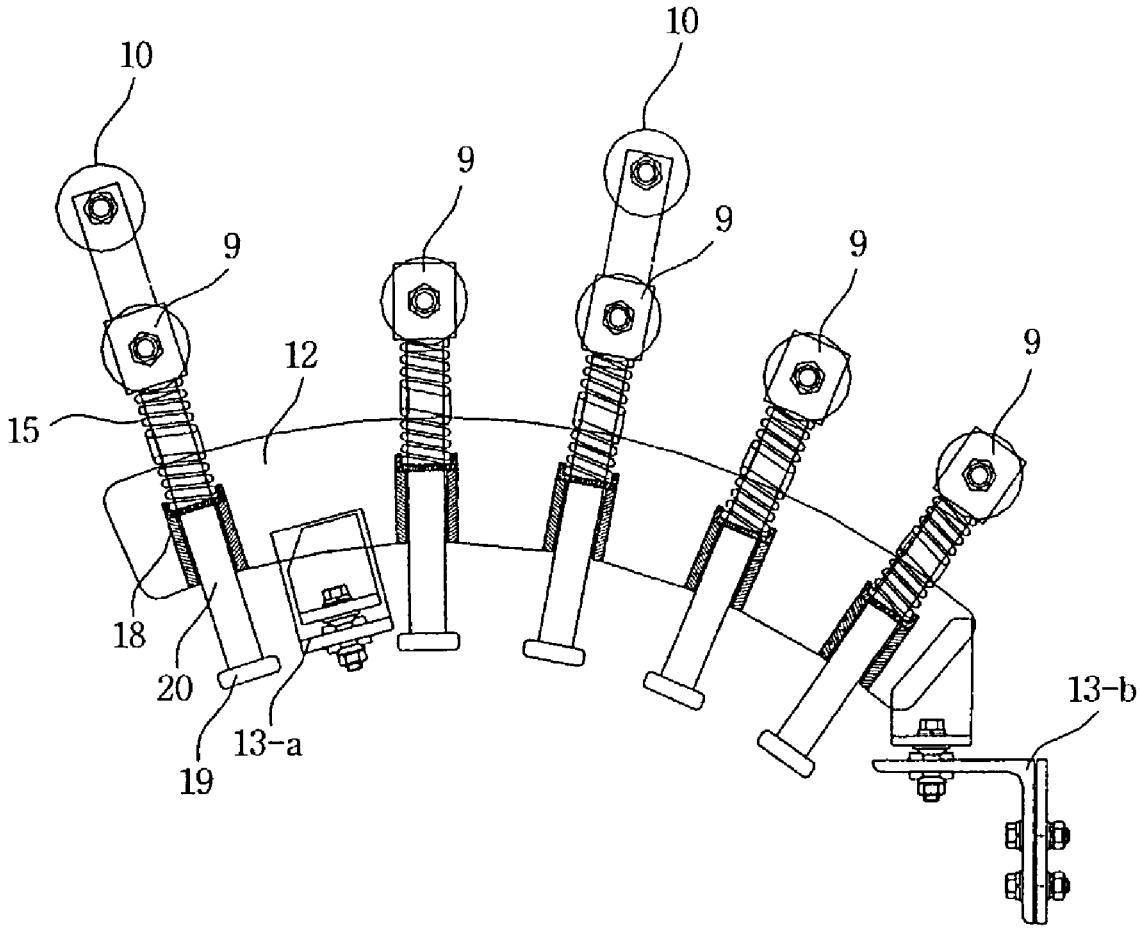
FIG. 4*b* is a side view showing a curvature adjustable handrail length compensation device in accordance with the present invention.

FIGS. 4*a* and 4*b* are side views showing a curvature-adjustable handrail length compensation device in accordance with the present invention. The device depicted in FIG. 4*a* is located between driving pulley 2 (see FIG. 1) and the upper turnaround area, and the device depicted in FIG. 4*b* is located between driving pulley 2 and the lower turnaround area. The device commonly comprises curved frames 8 and 12, which are fixed to a truss by brackets 11*a*, 11*b*, 13*a* and 13*b*. Hollow cylindrical sleeves 18 are mounted in a radial direction to curved frames 8 and 12 and arranged along the overall length of curved frames 8 and 12. Sleeves 18 are apart from each other at a regular distance. Supporting rod 20 is movably provided in each cylindrical sleeve 18 and passes through frame 8 and 12. First supporting roller 9 is rotatably mounted to the upper end of each supporting rod 20. Second supporting rollers 10 are mounted to some of supporting rods 20. Second supporting rollers 10 are disposed above first supporting rollers 9, so that handrail 1 (see FIG. 1) moves therebetween. Second supporting rollers 10 prevent handrail 1 from meandering.

Spring 15 is provided around supporting rod 20 between sleeve 18 and first supporting roller 9, to bias first supporting roller 9 toward the outer surface of handrail 1. Handrail 1 presses first supporting rollers 9 down against the elasticity of springs 15 by its weight. Stopper 19 is formed at the lower end of each supporting rod 20. Stopper 19 is larger than the diameter of cylindrical sleeve 18 for preventing supporting rod 20 being separated from frame 8 and 12.

During operation of the escalator, if a portion of handrail 1 passing by driving pulley 2 is loosened and wrinkled, the tension of handrail 1 and the pressing force applied to first supporting rollers 9 are not uniform over the whole length of frame 8 and 12. However, since each first supporting roller 9 is elastically supported by its own spring 15, first supporting rollers 9 are independently located at a position where the pressing force of handrail 1 and the elastic force of spring 15 are in equilibrium. Accordingly, the curvature of wrinkled handrail 1 can be properly adjusted at the every contact point with first supporting rollers 9, thereby optimally compensating the length of handrail 1.

As described above, the device of the present invention can adjust the loosened or wrinkled handrail to have an optimum curvature by means of supporting rollers, which can be moved independently according to the change in tension of the handrail. Accordingly, the steep bending and physical damage of the handrail are reduced and the operational stability of the escalator system is enhanced.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A curvature-adjustable handrail length compensation device, comprising:

a frame;

a plurality of handrail supports mounted along a length of the frame, each handrail support comprising at least one roller; and a plurality of springs between a corresponding roller and the frame to elastically support each of the plurality of handrail supports so that each of the handrail supports move independently up and down.

2. The curvature-adjustable handrail length compensation device of claim 1, wherein each handrail support includes a supporting rod movably mounted through the frame, the roller being mounted to an end of the supporting rod to support the handrail, and a stopper formed at the other end of the supporting rod, and wherein each of the plurality of springs is provided around the supporting rod and biases the roller away from the frame.

3. The curvature-adjustable handrail length compensation device of claim 2, wherein each handrail support further includes a second supporting roller disposed relative to the roller so that the handrail moves therebetween.

4. The curvature-adjustable handrail length compensation device of claim 3, wherein the roller and the second supporting roller are mounted to the same supporting rod.

5. The curvature-adjustable handrail length compensation device of claim 1, wherein the frame has a predetermined curvature.

6. The curvature-adjustable handrail length compensation device of claim 1, wherein the handrail length compensation device is located between a handrail driving unit and an upper turnaround area, and between the handrail driving unit and a lower turnaround area.

7. The curvature-adjustable handrail length compensation device of claim 1, wherein the plurality of handrail supports extend radially from the frame.

8. The curvature-adjustable handrail length compensation device of claim 1, wherein movement of one of the plurality of handrail supports is decoupled from movement of another of the plurality of handrail supports.

9. A curvature-adjustable handrail length compensation device, comprising:

a handrail support mountable along a length of a frame;

the handrail support comprising a movable supporting rod;

a first supporting roller mounted to one end of the supporting rod and a stopper formed at the other end of the supporting rod;

a spring disposed between the first supporting roller and the stopper to elastically support the first supporting roller;

a second supporting roller disposed relative to the first supporting roller so that a handrail is movable therebetween; and wherein the first supporting roller and the second supporting roller are mounted to the same supporting rod.

10. A passenger conveyor handrail assembly, comprising:

a handrail;

a frame;

a plurality of handrail supports mounted along a length of the frame, each handrail support comprising at least one roller that directly contacts the handrail and provides support to the handrail; and a spring associated with each handrail support to elastically support the associated handrail support so that each of the handrail supports is moveable relative to the frame independently of the other handrail supports.

11. The assembly of claim 10, wherein each spring is between an associated roller and the frame.

12. The assembly of claim 10, wherein each handrail support includes a second roller on an opposite side of the handrail from the roller that directly contacts the handrail.

13. The assembly of claim 10, wherein each handrail support includes a supporting rod that is moveably mounted relative to the frame and wherein the associated spring biases the rod and the roller in a direction away from the frame toward the handrail.

* * * * *